United States Patent [19]

Ross

[11] 4,368,907

[45] Jan. 18, 1983

[54] APPARATUS FOR PICKING UP ANIMAL WASTE

[76] Inventor: Bernard M. Ross, 3855 McDonald Ave., St. Louis, Mo. 63116

[21] Appl. No.: 301,223

[22] Filed: Sep. 11, 1981

[51] Int. Cl.[3] ..... A01K 29/00

[52] U.S. Cl. ..... 294/1 BA

[58] Field of Search ..... 294/1 BA, 1 B, 1 BB, 294/19 R, 55, 57, 53.5, 50.9, 100, 101; 15/257.1, 257.3, 257.6, 257.7, 104.8; 119/1 R

[56] References Cited

U.S. PATENT DOCUMENTS 4,032,182 6/1977 D'Ath ..... 294/1 BA 4,102,547 7/1978 Williams ..... 294/1 B

*Primary Examiner*—James B. Marbert

*Attorney, Agent, or Firm*—Haverstock, Garrett & Roberts

[57] ABSTRACT

A device for use in gathering and removing animal waste and other debris including a compartmented container assembly having first and second compartments formed therein, the container assembly having first and second end portions and a central opening extending therethrough, a first closure member pivotally mounted to the first end portion of the container assembly to control access to the first compartment, a second closure member disposed at an intermediate location between the first and second end portions of the container assembly across the central opening separating the container into the first and second compartments, the second closure member being movable between a normally closed position separating the first and second compartments and an open position angularly related thereto for allowing passage of the waste debris from the first compartment into the second compartment, a third closure member pivotally mounted to the second end portion of the container assembly to control access to and exit from the second compartment, a handle member attached to and extending upwardly from the container assembly, and operator assemblies operable from the handle member for selectively controlling the opening and closing of the first and third closure members. The present device may also optionally include a member slidably insertable within the second compartment for supporting a disposable bag liner in open position to receive the waste debris as it is transferred from the first compartment to the second compartment.

20 Claims, 5 Drawing Figures

APPARATUS FOR PICKING UP ANIMAL WASTE

The present invention relates to a sanitary device for use in picking up, temporarily storing, and disposing of animal waste such as the fecal matter of a dog or other animal, and, more particularly, to a waste pickup device including a compartmented container assembly having first and second compartments defined therein and separated by a pivotally mounted closure member disposed therebetween for allowing transfer of the waste material from one compartment to another for storage therein. The present device also embodies means for detachably holding a disposable bag liner or receptacle within the container assembly for receiving the waste material as it is transferred from the first compartment into the second compartment. Although the present device has particular application in collecting, storing and disposing of animal waste, it can also be conveniently utilized to gather and remove a wide variety of other waste debris.

Many different kinds of waste pickup devices are known and have been employed for use in collecting and removing animal waste. Such known pickup devices teach a wide variety of constructions, most of which include a single compartment container adaptable for receiving and holding waste debris therein having a handle-operator assembly attached thereto, a pivotally mounted closure member for allowing access into the container, and actuating means operable from the handle assembly for selectively moving the closure member between its open and closed positions. Typical of such known constructions are the pickup devices disclosed in U.S. Pat. Nos. 3,431,008; 3,868,135; 4,042,269; and 4,148,513. Still other known constructions utilize pickup means which include a pair of relatively movable, cooperatively engageable jaws or blades positioned at the lower end portion of the device for picking up the waste material, see for examples the constructions disclosed in U.S. Pat. Nos. 4,210,351 and 4,425,174. In certain other constructions there is also provided means for scooping the waste debris into the container assembly such as the scoop arrangement disclosed in U.S. Pat. No. 4,200,321.

All such prior art devices suffer from certain disadvantages and shortcomings. For example, the known constructions for the most part are characterized by complicated and cumbersome mechanisms which are relatively difficult to manipulate and maneuver in order to properly effect pickup and disposal of the waste material; many constructions do not provide means for increasing the waste holding capacity of the devices; and many do not provide sanitary means for dumping the accumulated debris once collected therein. In addition, many devices provide no means whatsoever for adequately retaining the gathered debris within the collecting portion of the device so as to allow the user to make repeated pickups prior to disposal of the accumulated debris, but instead, require that the debris collected therein be disposed of after each individual pickup. None of the known devices provide means for conveniently storing and trapping the accumulated debris within a segregated portion of the container assembly during the collecting process for disposal at some later time so as not to require the user thereof to interrupt and/or stop the collecting process in order to dump the assorted waste materials collected therein. For these and other reasons, the known constructions have not been entirely satisfactory and have enjoyed limited usefulness.

The present device overcomes these and other shortcomings and disadvantages associated with the known animal waste pickup devices and teaches the construction and operation of a relatively simple, more sanitary, and more efficient device for performing and accomplishing the necessary task of gathering and removing animal waste and other debris from lawns and other areas. In its preferred embodiment, the present device comprises a compartmented container assembly adaptable for holding and storing waste debris therein having a handle assembly attached thereto. The container assembly includes a generally rectangular enclosed housing structure having first and second compartments defined therein. The first compartment is located at the forward end portion of the container assembly and includes a first closure member pivotally mounted at its upper end portion to the forward portion of the first compartment for movement between a normally closed position and an elevated open position angularly related thereto for allowing access into the first compartment. A relatively simple linkage mechanism is attached to the first closure member and includes manually operable means located on the upper end portion of the handle assembly for pivotally rotating the first closure member between its opened and closed positions. A blade may be formed on or attached to the forward edge of the bottom wall of the first compartment to facilitate pickup of the waste material.

The second compartment of the container assembly is located adjacent to the first compartment and is separated therefrom by a second intermediate closure member pivotally attached to the container assembly and disposed entirely therewithin. The second closure member is movable between a normally closed vertical position and a rearward open position angularly related thereto, the second closure member being limited in its forward movement by a stop member located on the container side wall. The second closure member allows an operator to easily and conveniently transfer the waste material accumulated within the first compartment into the second compartment by simply tilting the entire container assembly forwardly and upwardly. This tilting motion allows the second intermediate closure member to swing open thereby allowing the waste material to pass into the second compartment. Once transfer is complete, the operator need only return the container assembly to its normal upright position thereby allowing the second closure member to freely swing downwardly into its vertically closed position against the stop member. This feature of the present device enables a user to easily and conveniently store and trap the waste material within the second compartment and facilitates the additional pickup of waste material into the first compartment. This is particularly advantageous because it enables the user to gather and collect a plurality of waste materials over a relatively large area without repeatedly disposing of the debris after each individual pickup and it enables a greater amount of accumulated debris to be collected therein as compared to the known prior art. In addition, this provides for a faster, more efficient means of performing and accomplishing the necessary task of gathering and removing animal waste and other debris.

A third closure member is pivotally attached to the container assembly at the rear end portion thereof and is likewise controlled by a relatively simple linkage mechanism similar to the mechanism utilized in opening and closing the first closure member. Operator actuator means located on the handle assembly are also provided for controlling the raising and lowering of the third closure member and opening of the third closure member allows the user to easily and conveniently dump the accumulated debris from within the second compartment. In addition, an optional frame member dimensioned so as to be slidably inserted within the second compartment may be employed for detachably holding a disposable bag liner in position to receive the waste material or other debris as it is transferred from the first compartment into the second compartment. Use of the optional frame member with disposable liner provides a further sanitary means for enabling a user to easily and conveniently collect, store and dump animal waste or other debris without soiling the inside of the second compartment and without losing debris therefrom. Additionally, alternative embodiments of the present device may include electrical means for controlling movement of the first and/or third closure members between their open and closed positions.

It is therefore a principal object of the present invention to provide a simple, more efficient device for effectively collecting and removing animal waste and other assorted waste materials, which device includes means for conveniently storing and retaining the debris accumulated during the collecting process within a segregated portion of the container assembly for disposal at some later time.

Another object is to provide a pickup device which substantially increases the amount of debris which can be collected prior to the disposal thereof and effectively reduces the overall time required for the collecting operation.

Another object is to teach the construction and operation of a pickup device which provides an extremely sanitary method for removing and disposing of animal waste.

Another object is to provide a pickup device from which the accumulated waste debris may be easily removed and deposited at any desired location.

Another object is to teach the construction and operation of a pickup device which enables a user to make repeated pickups without dumping and which can be utilized to remove assorted waste materials from a relatively large area without requiring the user thereof to interrupt and/or stop the collecting process.

Another object is to provide a relatively inexpensive construction which is lightweight, durable and requires relatively little maintenance.

Another object is to provide a pickup device including means for detachably holding a disposable bag liner within the container assembly, which liner is operatively positioned to receive the waste material as it is collected therein.

Another object is to provide a pickup device which enables the user thereof to deliver and dump a greater amount of accumulated debris as compared to the known prior art.

Another object is to provide a pickup device which does not require the debris collected therein to be disposed of after each individual pickup.

Another object is to provide a relatively simple construction which can be economically produced for both commercial and non-commercial use.

These and there objects and advantages of the present invention will become apparent to those skilled in the art after considering the following detailed specification of the present device in conjunction with the accompanying drawings, wherein.

Figure 1:
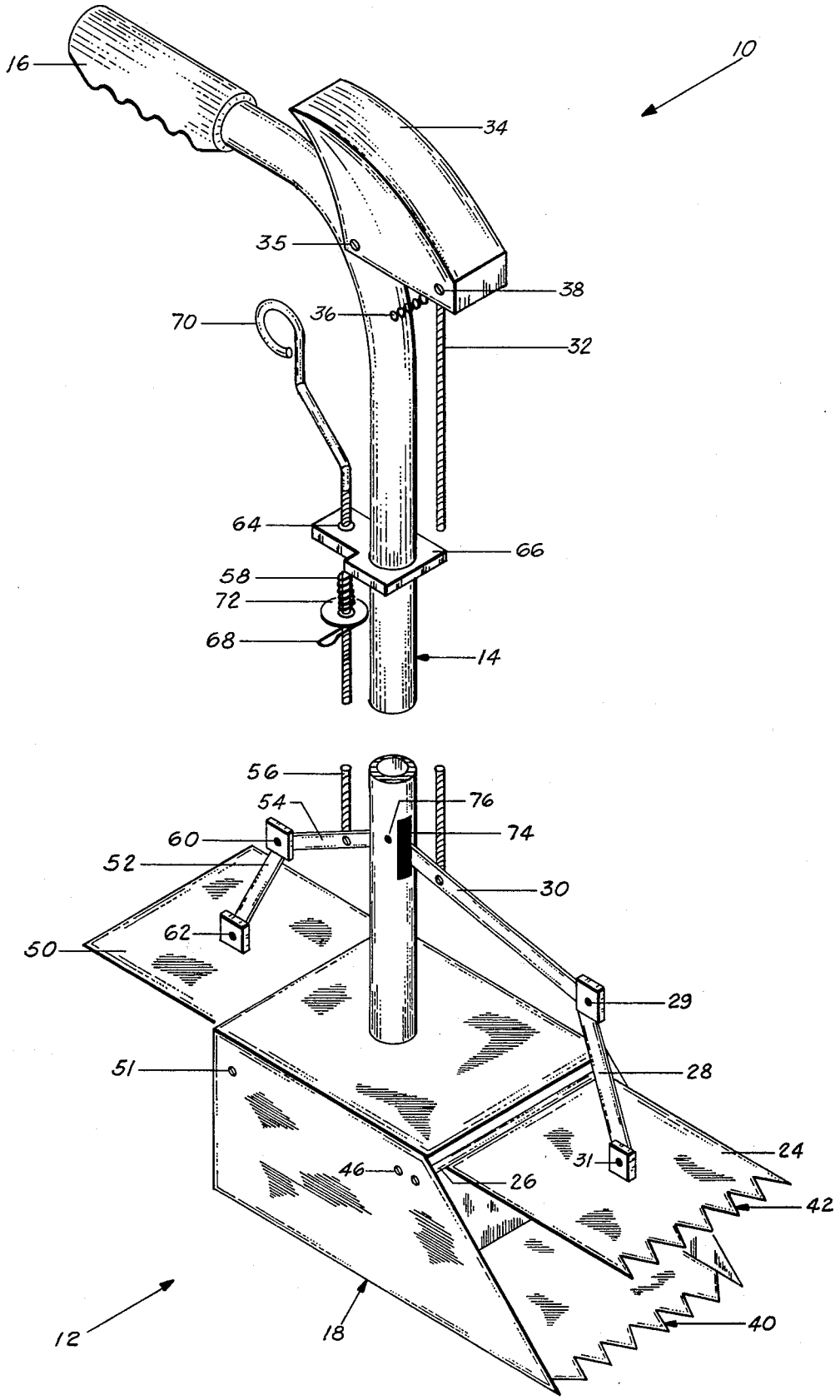
FIG. 1 is a perspective view of a waste pickup device constructed according to the teachings of the present invention showing the front and rear closure members in their open positions.
Figure 2:
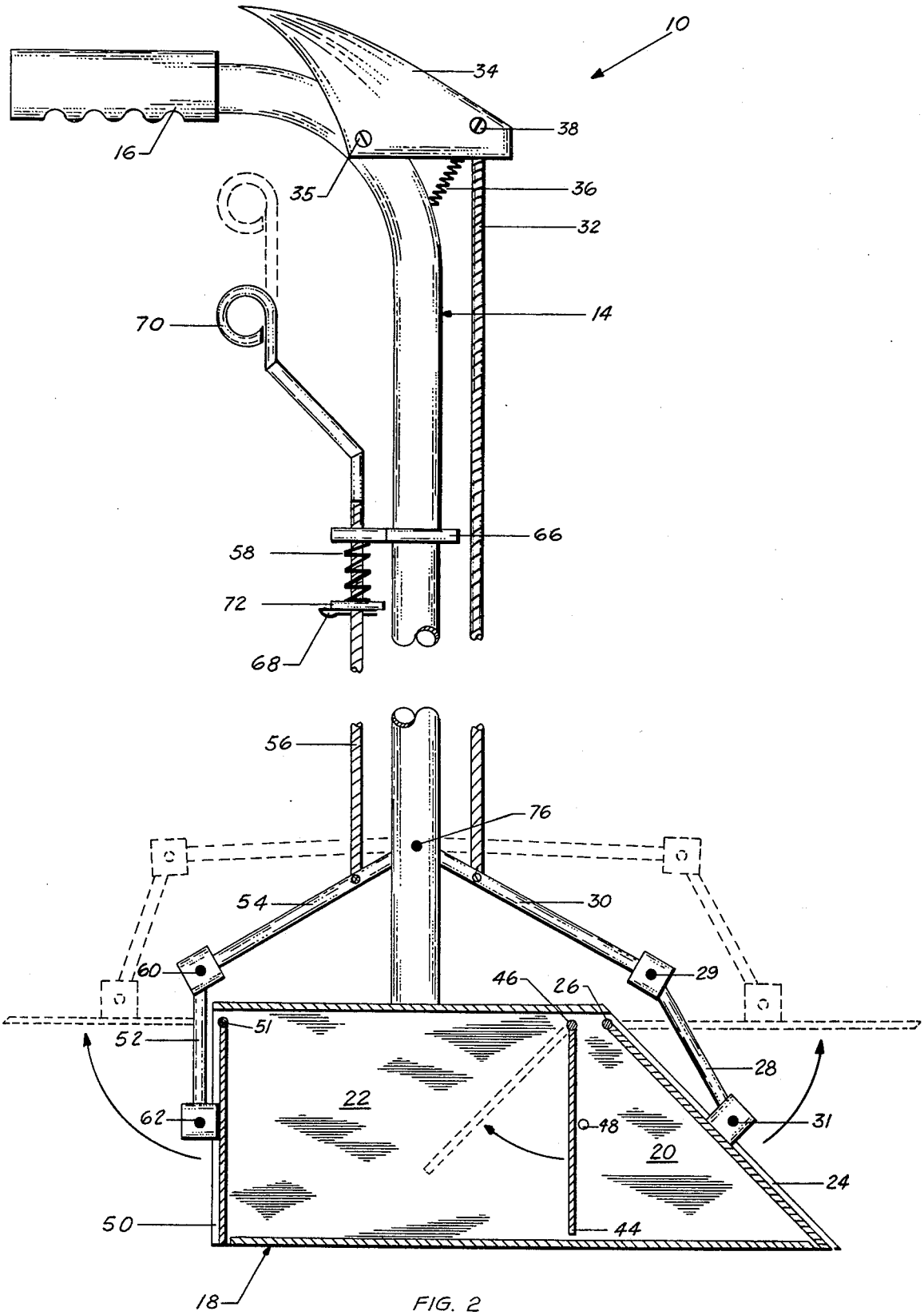
FIG. 2 is a side elevational view of the device of FIG. 1 showing the container assembly in cross-section, the closure members being shown in solid outline in their closed positions and in dotted outline in their open positions.

Referring to the drawings more particularly by reference numbers and wherein like numerals refer to like parts, number 10 in FIG. 1 identifies an apparatus for picking up, storing and disposing of animal waste and other debris constructed according to the teachings of the present invention. The device 10 comprises a compartmented container assembly 12 adaptable for holding and storing waste debris therein having a handle assembly 14 attached thereto as shown in FIGS. 1 and 2. The upper end portion of the handle assembly 14 is conveniently shaped for ease of handling and is fitted with a comfortable grip member 16 such as a conventional rubber hand grip commonly used on bicycles and the like or any other suitable member so as to facilitate the grasping of such handle member by the operator.

The container assembly 12 includes an enclosed elongated generally rectangular housing structure 18 having first and second compartments 20 and 22 respectively defined therein. The first compartment 20 is located at the forward end portion of the housing structure 18 and is substantially triangular in shape as shown in FIG. 2. A first closure member or door 24 is pivotally mounted at its upper end portion to the forward portion of the first compartment 20 by any suitable pivot means such as the pivot rod member 26 (FIG. 1) for movement between a fully closed position shown in solid outline and an elevated position angularly related thereto shown in dotted outline allowing access into the first compartment. A relatively simple linkage mechanism including the pivotal arm members 28 and 30, a control wire 32, and a manually operable actuating lever 34 positioned on the upper end portion of the handle assembly 14 is utilized for pivotally raising and lowering the closure member 24. The arm members 28 and 30 are pivotally attached to each other by any suitable pivot means such as the pivot pin member 29 and arm member 28 is pivotally attached to its opposite end portion to the closure member 24 such as by the pin member 31. The control wire 32 extends along and is spaced from the upright portion of the handle 14 and has one end portion securely attached to the arm member 30 at an intermediate location therealong and has its opposite end portion attached to the operating lever 34 as at 38. It should be noted that the operator lever 34 is likewise pivotally attached to the upper end portion of the handle 14 by any suitable pivot means such as the pin member 35 in such a position so as to be readily accessible to the operator thereof as shown in FIGS. 1 and 2.

The primary means for holding and maintaining the closure member 24 in its normally closed position is a spring member 36 shown in FIGS. 1 and 2. The spring 36 is secured at one end portion thereof to the handle assembly 14 and is likewise securely attached at its opposite end to the forward portion of the operating lever 34. For ease of assembly, the spring member 36 and the upper end portion of the control wire 32 may be simultaneously attached to the lever 34 by a single fastener member such as the threaded member 38. A downward force on the operating lever 34 pivotally rotates the closure member or door 24, against the biasing action of the spring 36, to its fully open position as shown in dotted outline form in FIG. 2 and allows the operator to easily and conveniently scoop the waste material into the first compartment 20. A serrated edge 40 (FIG. 1) may also be formed on the forward edge of the bottom wall of the compartment 20 to facilitate pickup of the waste material. It is also recognized that a blade assembly (not shown) may likewise be attached to the bottom wall of the compartment 20 adjacent to the forward edge thereof to facilitate gathering. In addition, the closure member 24 may likewise include a corresponding serrated edge or interlocking fingers 42 as shown in FIG. 1 which cooperatively engage with the blade (not shown) or the serrated edge 40 to further facilitate pickup in grass and other like areas. Once the waste material is positioned within the first compartment 20, the operator need only release the downward force on the operating lever 34 and the closure member 24, through the urging force exerted by the spring 36, will again be lowered to its normally closed position thereby closing the forward compartment.

The second compartment 22 of the container 12, which is preferably larger in volume than the compartment 20, is located adjacent to the first compartment 20 and is separated therefrom by an intermediate closure member or gate 44 pivotally attached to the container 18 as at 46. The closure member 44 is disposed entirely within the container assembly 12 and may be pivotally attached thereto by any suitable means such as by a pin member or rod pivotally mounted so as to extend between the side wall portions of the housing structure 18 as shown in FIG. 2, or the member 44 may be pivotally attached to the top wall of the housing 18. The intermediate closure member 44 is movable between a normally closed vertical position separating the compartments 20 and 22 and a rearward open position angularly related thereto as shown in dotted outline form in FIG. 2. The downward and forward movement of the closure member or gate 44 toward the compartment 20 is limited by a stop member 48 located on the container side wall. The stop member 48 may include a flange, a knock out, or any other suitable means attached to one or both of the opposed side walls of the container assembly. The closure member 44 allows an operator to easily and conveniently transfer waste material accumulated within the forward compartment 20 into the aft compartment 22 by simply tilting the entire container assembly 18 forward and upwardly. This tilting motion allows the member 44 to freely swing rearwardly by gravity into its open position thereby allowing the waste material to pass unobstructed into the second or aft compartment. Once transfer is completed, the operator need only return the container assembly 12 to its normal upright position thereby allowing the intermediate door 44 to freely swing downwardly by gravity into its vertically closed position against the stop member 48. This feature of the present device is particularly advantageous because it enables the user to store and trap the waste material within the second compartment 22 during the collecting process and it provides a sanitary means for efficiently disposing of the accumulated debris thereafter. This storing capability in conjunction with the dual compartmental configuration of the container assembly 12 substantially increases the amount of debris which can be collected prior to any disposal thereof and it permits additional repeated pickups without dumping. This effectively reduces the overall time required for performing and accomplishing the necessary task of both gathering and removing animal waste and other debris from lawns and other areas. Storage of the waste materials in the the compartment 22 also reduces the odor commonly associated with such a task.

A third closure member or door 50 is pivotally attached at its upper end portion to the rear portion of the aft compartment 22 as shown at 51 in FIG. 2 and is likewise controlled by a relatively simple linkage mechanism similar to the mechanism utilized in the opening and closing of the first closure member 24. The closure member 50, like closure members 24 and 44, may be pivotally attached to the housing 18, as indicated, by any suitable pivot means. The linkage mechanism associated with the closure member 50 includes pivotal arm members 52 and 54, a control wire 56, and a second spring member 58 as shown in FIGS. 1 and 2. The linkage arm members 52 and 54 are pivotally attached to each other as at 60 by any suitable pivot means such as means similar to pivot means 29 and 31, and the arm member 52 is pivotally attached at its opposite end portion to the closure member 50 such as by the pivot pin member 62. The control wire 56 extends along and is spaced from the upright portion of the handle 14 and it extends through an opening 64 formed in the flange member 66 as shown in FIG. 1 and has its lower end portion securely attached to the arm member 54 at an intermediate location therealong. The flange 66 is securely attached to the handle assembly 14 by any suitable attaching means. The control wire 56 has a pin member 68 which extends transversely therethrough or therearound at an intermediate location therealong below the flange 66 and the spring member 58 is positioned on the control wire 56 and extends between the transverse pin member 68 and the flange 66 to urge the closure member 50, through its associated linkage mechanism, downwardly into its normally closed position. The upper end portion of the control wire 56 includes a looped portion 70 which forms a separate ring actuating lever for controlling the opening and closing of the closure member 50. The spring member 58 continuously biases the closure member 50 in its closed position thereby retaining the accumulated debris within the second compartment 22 until such time the ring actuating lever 70 is activated permitting disposal thereof. A manual upward pull on the ring lever 70 pivotally rotates the closure member 50 in opposition to the biasing action of the spring 58 and allows the operator to open the rear closure member 50 to dump the accumulated debris collected within the second compartment 22. Once dumping is complete, the operator need only release the ring lever 70 and the closure member 50, through the urging force exerted by the spring 58, will again be lowered to its normally closed position.

It should be noted that an additional member such as the washer member 72 shown in FIGS. 1 and 2 may be interposed between the pin member 68 and the lower portion of the spring member 58 for bearing against the pin member 68 and providing additional support for the spring 58. In addition, it should also be noted that the upper end portions of arm members 30 and 54 extend through slots or openings 74 in the handle assembly 14 as shown in FIG. 1 and, for ease of assembly, they may be conveniently pivotally attached to a common pivot means such as the pivot pin member 76.

The use of separate operator actuated means located on the handle assembly for opening and closing the rear closure member 50 is highly desirable because it substantially eliminates inadvertent dumping of the accumulated debris which often occurs in devices wherein both the collecting and dumping processes are controlled by a common actuating lever. This also enables an operator to effectively utilize the subject device without ever having to bend over or otherwise stoop during use thereof. In addition, the independently operable rear closure member 50 greatly facilitates the disposal of the accumulated debris collected within the device 10 and provides a more sanitary means for easily and conveniently removing and depositing such debris at any desired location. Additionally, the subject device is easy to wash and maintain.

Figure 3:
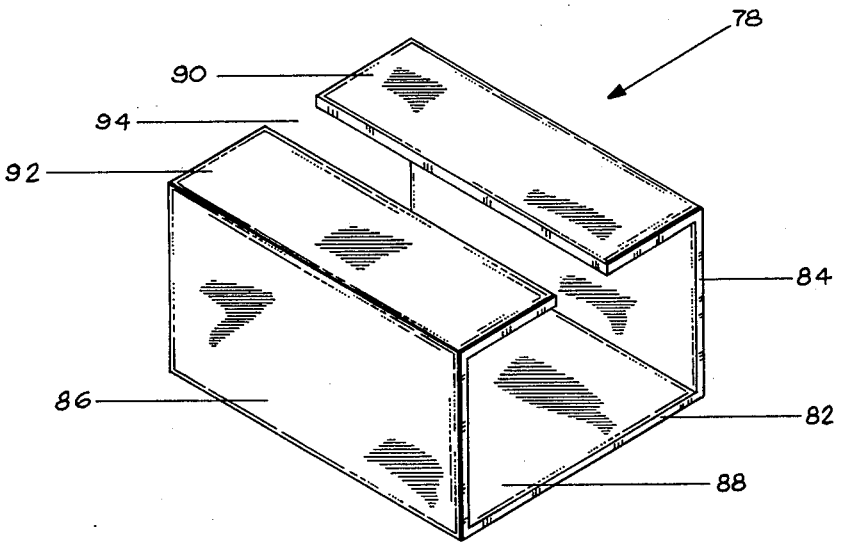
FIG. 3 is a perspective view of an optical insert frame member for detachably holding and supporting a disposable bag liner within the container assembly.
Figure 4:
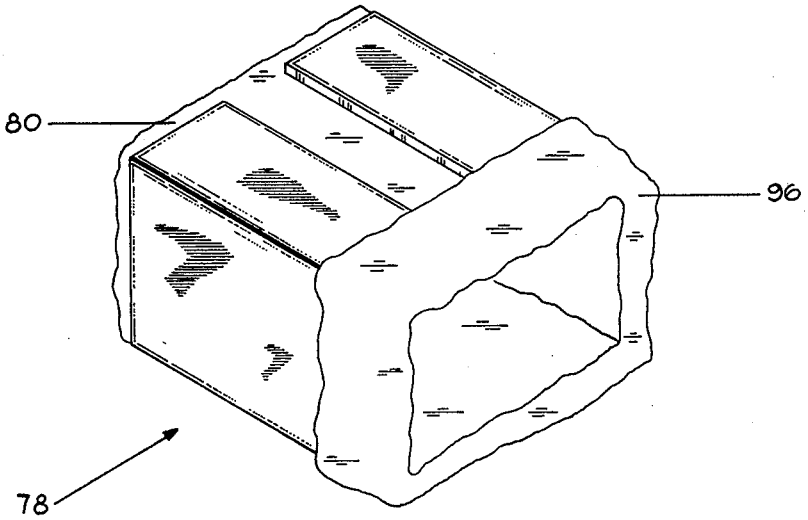
FIG. 4 is a perspective view of the frame member of FIG. 3 showing a disposable plastic bag liner operatively positioned thereon.

FIGS. 3 and 4 disclose an optional elongated frame member 78 adaptable for detachably holding a disposable bag liner 80 or other receptacle dimensioned so as to be slidably inserted within the second compartment 22 whenever the rear closure member 50 is held in its open position. The frame member 78 is generally rectangular in shape and includes a bottom wall 82 and a pair of spaced and opposed side walls 84 and 86 which extend upwardly therefrom defining opposite sides of a channel 88 which extends through the frame member 78 from one end portion to the other. The frame member 78 also includes flange portions such as the portions 90 and 92 which are shown being integrally formed with the respective side walls 84 and 86. The flange portions 90 and 92 extend towards each other part way across the channel 88 so as to at least partially overhang the channel 88 and together form a slot or opening 94 therebetween which aids in properly positioning the disposable bag liner 80 within the member 78 as will be hereinafter explained. The bag liner 80 or other disposable receptacle is preferably inserted within the frame member 78 from one end portion thereof and the open end portion of the liner is folded back over the opposite end of the frame member 78 as shown at 96 in FIG. 4. Access to the bag liner 80 to achieve proper positioning within the channel 88 during insertion therewithin may be achieved through the open opposite end portions of the frame member 78 and through the slot or opening 94. Once the bag liner 80 is properly positioned within the frame member 78, the member 78 is slidably positioned within the second compartment 22 such that the open end portion of the disposable liner 80 lies adjacent to or abuts the intermediate closure member 44. This allows the liner 80 or any other disposable receptacle to receive the waste material as it is transferred from the forward compartment 20 into the aft compartment 22. A catch mechanism (not shown) may also be located on the handle assembly 14 in position to maintain the rear closure member 50 in its open position while the frame member 78 is being inserted within the compartment 22. It should be noted that sufficient clearance should exist between the abutting end portion of the frame member 78 and the closure member 44 so as not to interfere with or restrict the opening and closing of the closure member 44.

Use of the frame member 78 in conjunction with the disposable liner 80 provides a further sanitary means for enabling the user to easily and conveniently collect, store, and dump animal waste or other accumulated debris without soiling the inside of the second compartment 22 and without losing debris therefrom. In addition, the user's hand need never come in contact with the waste material and the container assembly 12 remains substantially clean and does not require continuous washing and the like. It is also recognized that the slot or opening 94 may be eliminated and the frame member 78 may simply include an elongated rectangular housing having open opposite ends associated therewith.

Figure 5:
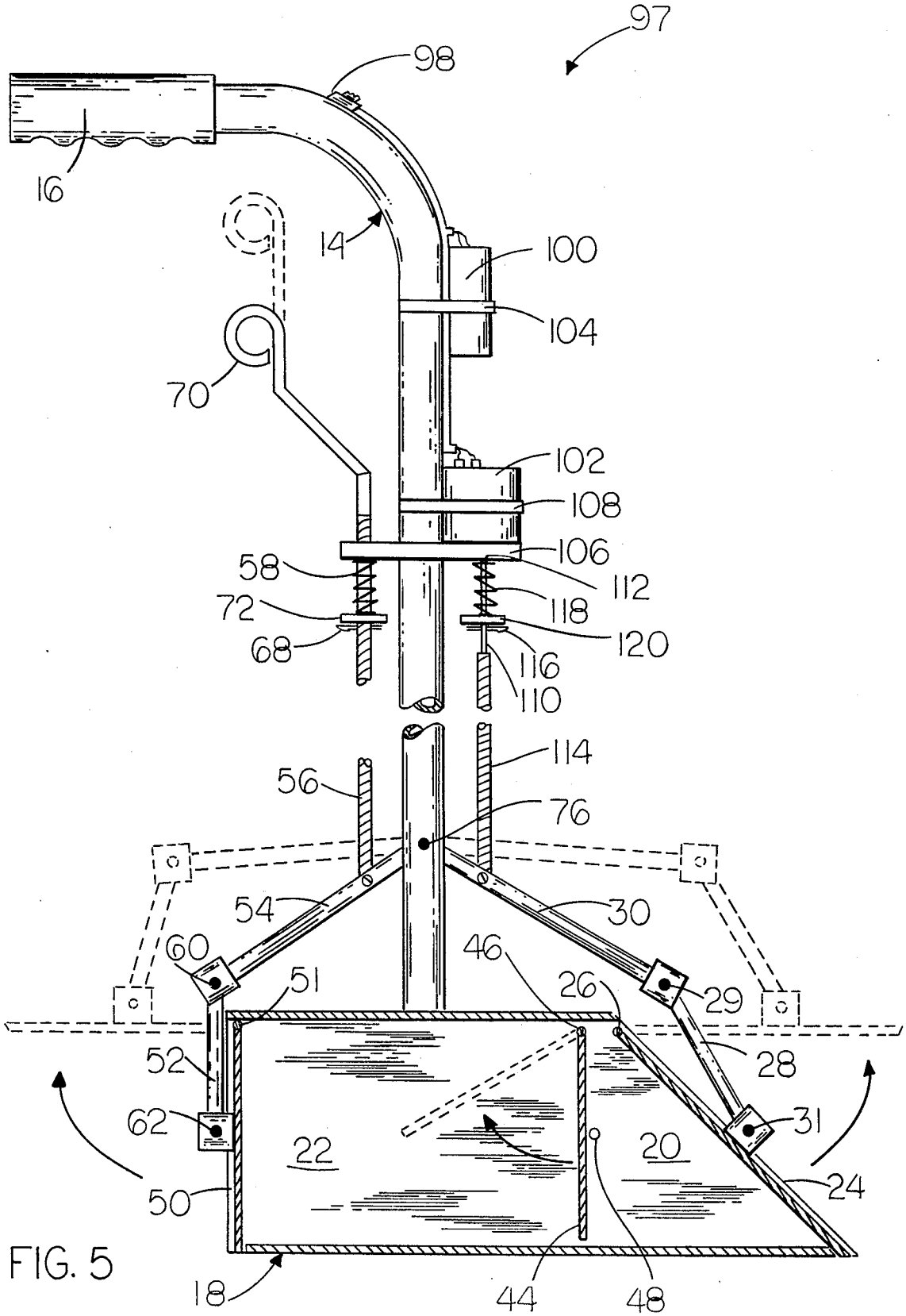
FIG. 5 is a side elevational view of another embodiment of the present device showing electrical means for opening and closing the first closure member.

FIG. 5 discloses an alternative embodiment 97 of the present device utilizing electrical means for controlling movement of the first closure member 24 between its open and closed positions. The electrical mechanism employed for pivotally raising and lowering the closure member 24 includes the switch means 98, a source of electrical power 100, an electrically activated solenoid 102, and a spring member 118. All other components comprising the embodiment 97 are arranged similarly to corresponding portions of the device 10 of FIGS. 1 and 2. The switch means 98 is suitably mounted on the upper portion of the handle assembly 14 in such a position so as to be readily accessible to the operator thereof as shown in FIG. 5. Although a single pole, push-pull type switch is preferred, any suitable switch means may be utilized. Both the switch means 98 and the solenoid 102 are powered by the common power source 100 which is also mounted on the handle 14 by any suitable mounting means such as by the strap means 104 shown in FIG. 5. Typical of such a power source 100 is a rechargeable battery pack which may consist of either a single battery or a plurality of batteries connected in series so long as the total power output produced thereby is sufficient to repeatedly energize the solenoid 102 for opening and closing the closure member 24 as will be hereinafter explained.

The solenoid 102 is mounted on the flange member 106 and, like the power source 100, is suitably attached to the handle 14 by any appropriate means such as by the strap means 108. The flange 106 is likewise securely attached to the handle assembly 14 by any suitable attaching means. The solenoid 102 includes a rod member or actuator 110 which extends through an opening 112 formed in the flange 106 and has its lower end portion operatively connected to one end portion of the control wire 114 as shown in FIG. 5. The opposite end portion of the control wire 114 is securely attached to the arm member 30 at an intermediate location therealong and movement of the arm member 30 controls the opening and closing of the closure member 24 as previously set forth hereinbefore. The rod member or actuator 110 has a pin member 116 which extends transversely therethrough or therearound at an intermediate location therealong below the flange 106 and the spring member 118 is positioned on the rod member 110 and extends beween the transverse pin 116 and the flange 106 to urge the rod member or actuator 110 downwardly into its fully extended position whenever the solenoid 102 is not electrically engaged. A washer member 120, similar to the member 72 shown in FIGS. 1 and 2, may be interposed between the pin 116 and the lower portion of the spring 118 for bearing against the pin 116 and providing additional support for the spring 118.

The spring 118 continuously biases the closure member 24, through its associated linkage mechanism as hereinbefore described, downwardly into its normally closed position until such time the solenoid 102 is energized by activation of the switch means 98. Once the solenoid 102 is energized, the rod member 110 is electrically moved upwardly against the biasing action of the spring 118 thereby pivotally rotating the closure member or door 24 to its fully opened position as shown in dotted outline form in FIG. 5. Once the waste material is positioned within the compartment 20, the operator need only activate the switch means 98 to its closed position thereby de-energizing the solenoid 102 and the rod member or actuator 110, through the urging force exerted by the spring 118, will again be lowered to its fully extended position. This de-energizing of the solenoid 102 and extension of the actuator 110 moves the closure member 24 to its normally closed position closing the forward compartment. It is also important to note that, although not shown, it is anticipated that the opening and closing of the third closure member or door 50 may likewise be accomplished electrically by use of a power source, a solenoid, additional switch means or other electrical means similar to the means hereinbefore described with reference to the electrical operation of the first closure member 24.

Although it is recognized that various acceptable materials of construction are available and could be equally as well employed to construct the various elements of the present device, it is preferred that all such elements be constructed of lightweight, durable materials such as certain plastic or metal materials which are both readily available and inexpensive.

Thus there has been shown and described a novel apparatus for effectively and efficiently picking up, storing, and disposing of animal waste and other debris, which apparatus fulfills all of the objects and advantages sought therefor. Many changes, modifications, variations and other uses and applications of the present construction will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A device for use in gathering and removing animal waste and other debris comprising a container body having first and second compartments formed therein, said container body having first and second end portions and a central opening extending therebetween, handle means attached to and extending upwardly from said container body, a first closure member pivotally mounted to the container body adjacent to the first end portion thereof to control access to said first compartment, said first closure member being movable relative to said first end portion between a position closing the first compartment and an open position angularly related thereto, a second closure member disposed at an intermediate location between the first and second end portions of the container body across said central opening separating the container body into said first and second compartments, said second closure member being movable between a normally closed position separating the first and second compartments and an open position angularly related thereto for allowing passage of the waste debris from said first compartment into said second compartment, a third closure member pivotally mounted on the container body adjacent to the second end portion thereof to control access to and exit from said second compartment, said third closure member being movable relative to said second end portion between a position closing the second compartment and an open position angularly related thereto, and separate operator means supported on said handle means operatively engageable with said first and third closure members for selectively controlling the opening and closing of said first and third closure members.

2. The device defined in claim 1 wherein said second closure member is disposed entirely within said container body.

3. The device defined in claim 1 including means for limiting angular movement of said second closure member.

4. The device defined in claim 1 wherein said separate operator means for selectively controlling the opening and closing of said first and third closure members includes first actuatable means operatively connected to said first closure member and second separate actuatable means operatively connected to said third closure member.

5. The device defined in claim 1 including separate means respectively biasing said first and third closure members toward their closed positions.

6. The device defined in claim 4 wherein said first actuatable means includes a solenoid having an actuator member associated therewith operatively connected to said first closure member, a source of power, and switch means for supplying power from said power source to said solenoid for selectively controlling the opening and closing of said first closure member.

7. The device defined in claim 4 wherein said second actuatable means includes a solenoid having an actuator member associated therewith operatively connected to said third closure member, a source of power, and switch means for supplying power from said power source to said solenoid for selectively controlling the opening and closing of said third closure member.

8. A device adaptable for picking up and disposing of animal waste and other debris comprising an elongated container assembly having first and second end portions and an opening extending therethrough, a closure member extending transversely across said opening at an intermediate location between said first and second end portions to separate the opening into first and second compartments on opposite sides thereof, said first compartment extending towards the first end portion of said container assembly for receiving waste materials therein and the second compartment extending from the intermediate closure member towards the second end portion of said container assembly for receiving and storing waste material from said first compartment, a front closure member mounted on the container assembly adjacent to the first end portion and including pivot means associated therewith enabling said front closure member to be rotated relative to the container assembly between a normally closed position adjacent to said first end portion and an open position angularly related thereto, a rear closure member mounted on the container assembly adjacent to the second end portion thereof including pivot means associated therewith enabling said rear closure member to be rotated relative to said container assembly between a closed position adjacent to said second end portion and an open position angularly related thereto, a handle assembly attached to and extending from said container assembly, separate means biasing said front and rear closure members toward their respective closed positions, first actuator means operatively connected to the front closure member and operable in opposition to the respective biasing means to move the front closure member toward its open position, and second actuator means operatively connected to the rear closure member and operable in opposition to the respective biasing means to move said rear closure member toward its open position.

9. The device defined in claim 8 wherein said separate biasing means include a first resilient member associated with said first actuator means and a second resilient member associated with said second actuator means.

10. The device defined in claim 8 including means to limit angular movement of said intermediate closure member.

11. The device defined in claim 1 or 8 wherein the container assembly is substantially rectangular in shape.

12. The device defined in claim 1 or 8 including an insert slidable into the second compartment for detachably supporting a flexible disposable receptacle in position to receive the waste debris transferred from the first compartment to the second compartment.

13. The device defined in claim 1 or 8 wherein said first compartment includes a blade assembly attached to the container assembly adjacent to the first end portion thereof in position to facilitate the pickup of the waste materials.

14. A device advantageous for use in picking up and disposing of animal waste and other debris comprising an enclosed elongated generally rectangular housing structure having front and rear end portions and a passage extending therebetween, a first closure member pivotally mounted to the housing structure adjacent to the front end portion thereof for movement between a normal position closing the front end portion of the passage and an elevated open position angularly related thereto for allowing access into said passage, a second closure member mounted in the housing structure at an intermediate position and extending transversely across said passage dividing the passage into first and second compartments on opposite sides thereof, said second closure member being disposed entirely within said housing structure and being pivotally movable therein between a position closing the passage and separating said first and second compartments and a position angularly related thereto establishing communication between the first and second compartments, means for limiting movement of said second closure member in at least one direction of movement, a third closure member pivotally mounted on the housing structure adjacent to the rear end portion thereof for movement between a position closing the rear end of the passage and a position angularly related thereto, a handle member attached to and extending outwardly from said housing structure, first actuating means attached to the handle member and operatively connected to said first closure member including means for pivotally moving the first closure member between its closed and open positions, second actuating means attached to the handle member and operatively connected to said third closure member including means for pivotally moving the third closure member between its closed and open positions, first means associated with said first actuating means for biasing the first closure member towards its closed position, and second means associated with said second actuating means for biasing the third closure member towards its closed position.

15. The device defined in claim 14 including a frame member slidably insertable within the second compartment from the rear end portion of the housing structure for detachably supporting a flexible disposable liner member in open position to receive the waste materials from said first compartment when said second closure member is in its open position.

16. The device defined in claim 14 including means forming a serrated edge adjacent to the front end portion of the housing structure to facilitate the pickup of the waste materials.

17. The device defined in claim 16 wherein said first closure member includes a serrated edge portion for cooperating with the serrated edge associated with the front end portion of the housing structure.

18. The device defined in claim 14 wherein said first actuating means includes a source of power, an actuator member operatively connected to said first closure member, and switch means actuatable by the user thereof for supplying power from said power source to said actuator member for pivotally moving the first closure member between its closed and open positions.

19. The device defined in claim 14 wherein said second actuating means includes a source of power, an actuator member operatively connected to said third closure member, and switch means actuatable by the user thereof for supplying power from said power source to said actuator member for pivotally moving the third closure member between its closed and open positions.

20. A device for use in picking up and disposing of waste materials such as animal waste comprising an elongated open ended tube-like container defined by an enclosed wall having connected top, bottom and spaced side walls, a first closure member hingedly attached adjacent to the top wall adjacent one end of the container, said front closure member being movable between a position closing the front end of the container and an open position angularly related thereto, a rear closure member hingedly attached adjacent to the top wall adjacent the opposite end of the container, said rear closure member being movable between a position closing the rear end of the container and an open position angularly related thereto, an intermediate closure member positioned in the container intermediate the ends thereof, said intermediate closure member being hingedly attached adjacent to the top wall and movable in the container between a position extending across the inside of the container separating the container into chambers located on opposite sides thereof and a position angularly related thereto, handle means extending upwardly from the top wall of the container, and separate first and second operator members mounted for movement on the handle, said first operator member having an operative connection to the front closure member and being movable to control the position thereof, and said second operator member having an operative connection to the rear closure member and being movable to control the position thereof.

* * * * *

UNITED STATES PATENT OFFICE

CERTIFICATE OF CORRECTION

Patent No. 4,368,907 Dated January 18, 1983

Inventor(s) Bernard M. Ross

It is certified that error appears in the above-identified patent and that said Letters Patent are hereby corrected as shown below:

Column 3, line 67 "there" should be --other--.

Column 4, line 13 "optical" should be --optional--.

Signed and Sealed this

*Fifteenth* Day of *March 1983*

[SEAL]

*Attest:*

GERALD J. MOSSINGHOFF

*Attesting Officer*

*Commissioner of Patents and Trademarks*